United States Patent [19]

Kugler

[11] Patent Number: 4,511,398

[45] Date of Patent: Apr. 16, 1985

[54] PROCESS FOR PURIFYING ALUMINUM WITH SODIUM

[75] Inventor: Tibor Kugler, Thayngen, Switzerland

[73] Assignee: Swiss Aluminium Ltd., Chippis, Switzerland

[21] Appl. No.: 513,472

[22] Filed: Jul. 13, 1983

[30] Foreign Application Priority Data

Jul. 23, 1982 [CH] Switzerland ..... 4510/82

[51] Int. Cl.[3] ..... C22B 21/06

[52] U.S. Cl. ..... 75/63; 75/68 R

[58] Field of Search ..... 75/63; 68 R

[56] References Cited

U.S. PATENT DOCUMENTS 2,239,277 4/1941 Stroup ..... 75/68 R 4,093,194 6/1978 Clare et al. ..... 266/215

FOREIGN PATENT DOCUMENTS 2438064 2/1975 Fed. Rep. of Germany ..... 75/68 R

*Primary Examiner*—M. J. Andrews

*Attorney, Agent, or Firm*—Bachman and LaPointe

[57] ABSTRACT

Aluminum contaminated with at least one of the metals of the groups II b, III a, IV a and V a of the periodic table of elements is purified by means of sodium applied in liquid extraction in a separating column in the temperature range between the melting point of the aluminum or aluminum alloys and the boiling point of sodium. The pre-heated sodium is introduced into the separating column from a circuit having a heat exchanger, solids precipitator, pump and storage tank, in quantities at least 5 times greater than the mass of contaminating metal. The sodium flows countercurrent to the contaminated aluminum which is also introduced into the separating column. The purified aluminum containing a small residual amount of contaminating metal and a sodium content not exceeding 500 ppm is removed from the separating column. The sodium containing a low concentration of contaminating metal is returned to the circuit.

14 Claims, 1 Drawing Figure

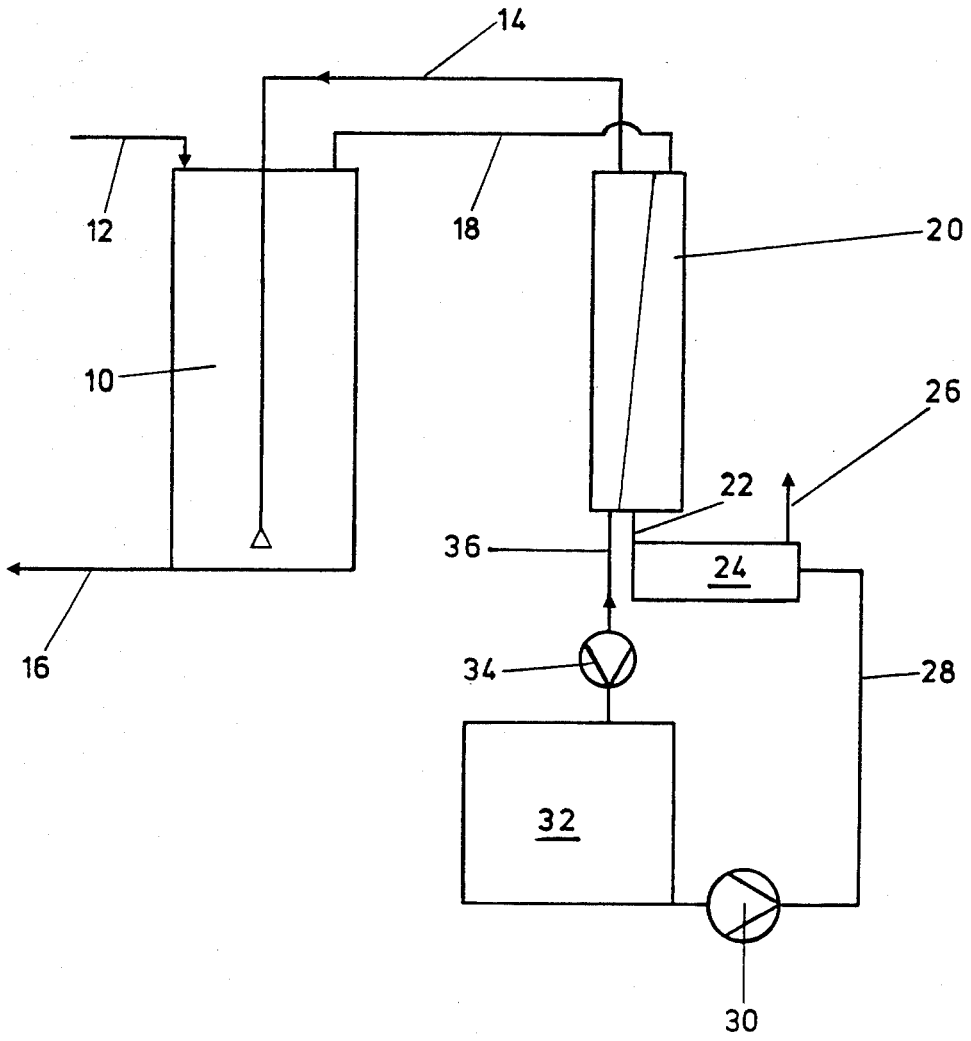
14
12
18
20
10
26
22
36
24
16
34
28
32
30

PROCESS FOR PURIFYING ALUMINUM WITH SODIUM

BACKGROUND OF THE INVENTION

The invention relates to a process for purifying aluminum contaminated with at least one of the metals of groups II b, III a, IV a and V a of the periodic table of elements by means of sodium and liquid extraction in a separating column in the temperature range spanning the melting point of aluminum or its alloys and the boiling point of sodium.

In the conventional process for producing aluminum via fused salt electrolysis in a cathodic tank lined with carbon and using carbon anodes the primary metal produced has a purity of 99.5% and more. In such a process neither the electrodes nor the molten electrolyte contaminate the molten aluminum to a significant degree.

Apart from the conventional process there exist specific processes for producing aluminum in which the metal is not produced in a relatively pure form but as an alloy:

The molten cathode of a fused salt reduction cell can be of lead or tin which combines with the precipitated aluminum to form a range of alloys.

In the carbothermic process for producing aluminum lead or tin is employed as absorbing agent either directly in the reduction furnace or after this in order to enable the aluminum to be separated from silicon and iron.

These methods of manufacturing aluminum can be employed on a significant technical scale if it is made possible to remove the residual 0.8 to 1.5% lead and tin to a level beyond the eutectic point.

In the U.S. Pat. No. 2,239,277 a process for purifying molten aluminum or aluminum alloys is proposed and namely such containing up to 1% of at least one of the impurities: antimony, bismuth, lead and tin. This is achieved by adding 0.1 to 1% sodium to the melt and stirring. As a result the dross so formed can rise to the surface of the melt and be removed. The addition of sodium takes place preferably in accordance with the stoichiometric amount required to form an intermetallic compound with the metal in question. Using this method it is possible, for example, to lower the lead content of an aluminum alloy from 0.94% to 0.28%. This concentration, however, lies far in excess of the permitted 50 ppm limit for lead in aluminum, thus making the process inapplicable on an industrial scale.

Described in the German Patent Publication No. 24 38 064 is a process for purifying metallic aluminum—in particular for the removal and recovery of bismuth, cadmium, gallium, mercury and tin. These elements can be present in metallic aluminum in amounts which are unacceptable for aluminum of normal commercial purity. The molten aluminum is brought into contact with an alkali metal such as sodium or potassium, for example. As with the above mentioned U.S. Pat. No. 2,239,277 the alkali metal is added in an amount which corresponds with the stoichiometry for formation of an intermetallic compound.

The proposed process according to the DE-OS No. 24 38 064 is such that provision is made, upstream for a conventional counter-flow extraction reactor, for a mixing stage where aluminum with a high concentration of tin is mixed with sodium having a low tin content. Subsequently, likewise upstream of the counter-flow extraction reactor, the mixture is separated in a series of parallel settling columns into two layers viz., a layer of aluminum low in tin content and a tin-rich sodium layer. The density of these two layers varies depending on the tin content of the sodium layer and does so to such an extent that one or the other layer lies on top. This overlapping of densities can cause difficulties in practice. The tin-bearing sodium alloy leaving the counter-flow extractor is fed back to the mixing stage. The purified aluminum is freed of the excess sodium by distillation of the sodium. The removal of tin from the equipment takes place in the second stage where tin-rich sodium alloys are removed.

The separation and removal of sodium rich tin alloys at elevated temperatures i.e. above the melting point of aluminum involves a number of technical problems; furthermore, a lot of sodium is lost with the tin which is removed.

The equipment employed for the process according to the German Patent Publication DE-OS No. 24 38 064 is complicated and the process itself is energy intensive.

It is therefore an object of the present invention to develop a process for purifying contaminated aluminum of at least one of the metals of groups II b, III a, IV a and V a of the periodic table of elements and this by means of a simple device and low energy consumption.

SUMMARY OF THE INVENTION

The foregoing object is achieved by way of the present invention wherein:

pre-heated sodium is introduced into the separating column from a circuit having a heat exchanger, solids precipitator, pump and storage tank, in quantities at least 5 times greater than the mass of contaminating metal, and flowing countercurrent to the contaminated aluminum which is also introduced into the separating column, the purified aluminum containing a small residual amount of contaminating metal and a sodium content not exceeding 500 ppm is removed and put to use, and the sodium containing a low concentration of contaminating metal is returned to the circuit.

BRIEF DESCRIPTION OF THE DRAWING

The FIGURE is a schematic illustration of a device for carrying out the process of the present invention.

DETAILED DESCRIPTION

The metals of the groups II b, III a, IV a and V a of the periodic system of elements are in particular: cadmium, mercury, gallium, tin, lead, antimony and bismuth. In practice the process according to the invention has found particular importance in the removal of lead and tin from aluminum and aluminum alloys.

Various tests carried out by the inventor have shown that it is unnecessary to have prior mixing of the aluminum—contaminated with one or more of the above metals—with a sodium alloy low in impurity content, as is the case in the DE-OS No. 24 38 064. Consequently one can avoid having to separate the resultant mixture into two different layers by standing it in another reactor. As well as saving man hours, this also enables considerable heat losses to be avoided.

In contrast to the known process sodium is, in accordance with the process of the invention, added to contaminated aluminum in quantities much in excess of the stoichiometric amount at which the most sodium rich intermetallic compound occurs. The mass of sodium added is preferably at least 10 times, in particular at least 30 times greater than that of the contaminating metal. At no phase of the fluid extraction process, therefore, does the aluminum come into contact with an impurity rich sodium alloy, but always only with a sodium alloy which has a low impurity content. As a result not only is the accuracy of separation increased but, in addition, the impurities can with certainty not be redissolved in the aluminum should the device come to a standstill. This effect can be increased further if a layer, some centimeters thick, of a likewise molten salt which is heavier than sodium floats on the molten aluminum. Such a salt can for example be made up of a mixture of sodium chloride and potassium chloride.

As both metals are separated from each other by a layer of salt i.e. have no common surface, no remixing can occur.

The counter-flow process in the separating column takes place preferably at a temperature between 650° and 750° C. The pure sodium is introduced from below, the contaminated aluminum from above, into the usefully vertical separating column.

The purified aluminum is tapped off at the lowest part of the separating column. It contains in industrial application normally 100–500 ppm sodium depending on parameters such as temperature and type of impurity. The excess sodium burns off on the surface or can be removed via fluxes, chlorine treatment or distilling, the last mentioned especially in vacuum. Apart from sodium the purified aluminum produced contains preferably at most 50 ppm of contaminating metals. Typical values obtained show that lead can be removed in the separating column until only 20–30 ppm remains.

The sodium flowing out of the separating column and low in impurity metals is cooled in a heat exchanger containing counter-flowing pure sodium at approximately 150° C. The pure medium employed as cooling medium flows to the separating column thus closing the circuit. This way only small amounts are required for heating the pure sodium. At a temperature which is low, yet well above the melting point of sodium, preferably 150°–200° C., a solid phase is formed between the sodium and the impurity metals in the aluminum. At this relatively low temperature it is possible to achieve a more distinct separation of the liquid and solid phases using known technical means without having to resort to known measures necessary for operating at higher temperatures.

The solid phase is separated from liquid sodium using a generally known separating device. For this e.g. a filter, filter candle, "Raschig" rings, a centrifuge or cyclone is employed.

A device for carrying out the process according to the invention will now be described with the aid of the accompanying schematic drawing. A separating column 10 is fed with impure aluminum via a supply pipe 12. This pipe 12 can, as shown in the drawing, connect up to the end of the separating column 10 or else to the upper region of its peripheral wall. The feed pipe 14 of the sodium closed circuit passes down the separating column 10 to the bottom; thus the pure sodium introduced rises and forms a stream flowing counter to the direction of the impure aluminum. The purified aluminum can be drawn off via pipe 16. The sodium containing the contaminating metal flows into the upper end region of the heat exchanger 20 via connecting pipe 18.

The separating column 10 is comprised, for example, of a chrome-nickel steel container coated on the inside with silicon carbide at least to a point above the maximum level of the impure aluminum. The layer of molten salt which separates both metals is provided preferably at this level.

The metal contaminated sodium is cooled to approximately 150° C. in the heat exchanger which simultaneously causes a solid phase to be precipitated. A run-out pipe 22 connected to the bottom of the heat exchanger 20 leads to a solids precipitator 24 where the solid phase is removed via outlet pipe 26. The then pure sodium flows to the storage tank 32 via connecting pipe 28 and pump 30.

The pure sodium is pumped by means of a pump 34 from this tank 32 through a connecting pipe 36 to the region of the floor of the heat exchanger 20. On flowing through the heat exchanger 20 the pure sodium cools the sodium contaminated with metal and is itself heated up. On entering the feed pipe 14 the pure sodium has therefore almost reached the operating temperature; only little extra energy need therefore be supplied.

The following examples show possibilities for application of the process according to the invention.

EXAMPLE NO. 1

An aluminum alloy containing 1 wt.% lead is passed at a flow rate of 20 kg/h through test equipment such as is shown in the accompanying drawing. The liquid extraction in the separating column takes place at a temperature of 700° C. Sodium is introduced into the separating column at a rate of 1 kg/h such that it flows in the direction counter to the aluminum contaminated with lead. The sodium contaminated with lead is cooled to 150° C. in the heat exchanger.

The analysis of the purified aluminum revealed a lead content of 0.3 wt.% and a sodium content of 0.01 wt.%. Aluminum with such a high lead content can be employed for only specific purposes, for example as heat-treatable free-machining alloys.

EXAMPLE NO. 2

An aluminum alloy with a lead content of 1 wt.% is introduced into the same separating column at the same rate and temperature as in the first example. The flow rate of the sodium, however, is increased to 6 kg/h.

The analysis of the purified aluminum revealed a lead content of 0.003 wt.% and a sodium content of 0.03 wt.%. Almost the whole of the lead in the metal had precipitated out as $Na_{15}Pb_4$ on a metal mesh installed as solids precipitator downstream of the heat exchanger.

Comparison of Examples No. 1 and 2 shows the significant influence of the amount of sodium employed. By increasing the sodium throughput rate by a factor of 6 the lead content can be lowered by a factor of 100.

EXAMPLE NO. 3

An alloy of 60 wt.% aluminum and 40 wt.% tin is introduced into the separating column at the same rate as in Example No. 2. Introduced into the separating column in counter-flow to the aluminum is sodium at 80 kg/h. The sodium contaminated with tin is cooled to 150° C. in the heat exchanger.

The analysis of the purified aluminum revealed a tin content of 0.002 wt.% and a sodium content of 0.05 wt.%.

The composition of the filter cake on the filter candle precipitator corresponded to $Na_4Sn$. The amount of sodium in the sodium circuit had dropped by 8 kg/h.

The above examples all refer to the purification of primary aluminum. It is self evident of course that the process according to the invention can be employed without substantial alteration also for the purification of scrap if it contains impurities amenable to removal by that method.

What is claimed is:

1. A process for purifying aluminum contaminated with an element selected from the group consisting of group II b, group III a, group IV a and group V a of the periodic table and mixtures thereof by liquid extraction in a separating column comprising:

providing a source of contaminated aluminum, a source of sodium, a heat exchanger and a separating column;

feeding a mass of said contaminated aluminum to said separating column;

feeding in countercurrent flow to said contaminated aluminum a quantity of sodium equal to at least five times the mass of the contaminating element so as to produce a purified aluminum product having a small residual amount of said contaminating element and a sodium content of not more than 500 ppm and a sodium product having a small concentration of said contaminating element; and removing said sodium product from said separating column and feeding said sodium product to said heat exchanger.

2. A process according to claim 1 further including the step of preheating said sodium prior to feeding to said separating column.

3. A process according to claim 1 wherein the liquid extraction takes place at a temperature between the melting point of said contaminated aluminum and the boiling point of sodium.

4. A process according to claim 1 wherein the liquid extraction takes place at a temperature between 650° and 750° C.

5. A process according to claim 1 further including the steps of feeding said contaminated aluminum from the top of the separating column and feeding the sodium from the bottom of the separating column.

6. A process according to claim 1 wherein said small residual amount of said contaminating element in said aluminum product is not greater than 50 ppm.

7. A process according to claim 1 further including the step of feeding sodium from said source to said heat exchanger wherein said sodium product is cooled in said heat exchanger by said sodium from said source so as to precipitate out a solid phase.

8. A process according to claim 7 wherein said sodium product is cooled to a temperature between 150° and 200° C. in said heat exchanger.

9. A process according to claim 1 further including the steps of passing said sodium product with precipitate from said heat exchanger to a solids precipitator and removing said precipitate from said precipitator.

10. A process according to claim 1 wherein said quantity of sodium is equal to at least ten times the mass of the contaminating element.

11. A process according to claim 1 wherein said quantity of sodium is equal to at least thirty times the mass of the contaminating element.

12. A process according to claim 1 further including the step of providing a layer of molten salt which is denser than sodium on the molten aluminum.

13. A process according to claim 12 wherein said molten salt is selected from the group consisting of NaCl, KCl and mixtures thereof.

14. A process according to claim 12 wherein said layer is several cm thick.

* * * * *